United States Patent [19]

Alich

[11] Patent Number: 5,022,318

[45] Date of Patent: Jun. 11, 1991

[54] APPARATUS FOR ADJUSTING THE ROLL GAP BETWEEN COOPERATING ROLLS

[76] Inventor: Günther Alich, Bernhofstrasse 51, 8134 Adliswil, Switzerland

[21] Appl. No.: 379,120

[22] Filed: Jul. 13, 1989

[30] Foreign Application Priority Data

Jul. 16, 1988 [CH] Switzerland ..... 2689/88

[51] Int. Cl.[5] ..... B30B 3/04

[52] U.S. Cl. ..... 100/47; 72/245; 72/246; 100/170; 100/171

[58] Field of Search ..... 100/47, 168–171, 100/176; 72/245, 246

[56] References Cited

U.S. PATENT DOCUMENTS

| | | | |
|---|---|---|---|
| 2,994,261 | 8/1961 | Cook | 100/170 X |
| 3,555,596 | 1/1971 | Thieme | 100/170 X |
| 3,730,079 | 5/1973 | Stirk et al. | 100/170 X |
| 4,817,407 | 4/1989 | Alich | 100/47 X |

FOREIGN PATENT DOCUMENTS

| | | | |
|---|---|---|---|
| 217937 | 10/1961 | Austria | 100/170 |
| 935363 | 8/1963 | United Kingdom | 100/170 |

*Primary Examiner*—Harvey C. Hornsby
*Assistant Examiner*—Stephen F. Gerrity
*Attorney, Agent, or Firm*—Henry M. Feiereisen

[57] ABSTRACT

An apparatus for adjusting the roll gap between cooperating rolls of a rolling stand for coating e.g. plastic foils or metal strips with a material which does not or does effect the roll gap includes a split bearing shell for each roll journal, with one shell half being part of a support unit and arranged inwardly relative to the roll gap and the other shell half being part of an adjusting unit and arranged outwardly relative to the roll gap. The individual elements of the adjusting units are arranged relative to the individual elements of the support unit in such a manner that the forces exerted free from play by the adjusting unit and of the support unit at both sides of the roll journals act in a common plane extending perpendicular to the axes of the rolls.

15 Claims, 4 Drawing Sheets

APPARATUS FOR ADJUSTING THE ROLL GAP BETWEEN COOPERATING ROLLS

BACKGROUND OF THE INVENTION

The present invention refers to an apparatus for adjusting the roll gap between cooperating rolls, and in particular to a rolling stand with at least two cooperating rolls which are supported in suitable bearings and movable relative to each other.

It is generally known to provide a mechanism for adjusting the roll gap by allowing one roll to be movable relative to the other roll. The EP-A2-0242783 describes a method for adjusting the roll gap in a foil coating machine for processing non-reactive material such as varnish or the like by providing an independent or autonomous system for supporting the cooperating rolls and adjusting the roll gap between the rolls through mutually bracing and connecting the elements of the adjusting and support unit in form-fitting and force-locking manner. Through provision of such an adjusting and support unit, the radial deviation of the inner raceways of the load support bearings as occurring in conventional machines is eliminated; however, the adjusting forces and supporting forces acting upon the roll journals cause a bending moment which negatively affects the parallelism of the roll gap.

SUMMARY OF THE INVENTION

It is an object of the present invention to provide an improved apparatus for adjusting the roll gap between cooperating rolls obviating the afore-stated drawbacks.

This object and others which will become apparent hereinafter are attained in accordance with the present invention by arranging the support elements for the roll journals of the rolls inwardly between the roll journals and by arranging the adjusting elements acting upon the roll journals in such relationship to the support elements that the forces exerted by the adjusting elements and by the support elements act in a common plane extending perpendicular to said axes of said rolls.

Through the provision of such a combined adjusting and support unit, external disturbances such as originating from bearing misalignment or from stand couplings and inner inherent roll bending forces are avoided as the support elements and the adjusting elements are arranged within each other so that the centrally acting adjusting forces and supporting forces extend in a common radial plane.

According to a further feature of the present invention, each roll journal is supported by a split bearing shell, with one shell half being part of the support unit and the other shell half being part of the adjusting unit. The shell halves of the support unit may suitably be connected within the inner area between the roll journals via a plurality of pressure spring bars while the shell halves of the adjusting unit are mounted outwards on the roll journals and cooperate with a cylinder/piston unit which may extend between the shell halves of the adjusting unit within the area between the roll journals or may also be arranged outside the area between the roll journals.

The cylinder/piston unit suitably cooperates with a variable pump for setting the adjusting force. In order to allow a very sensitive regulation of the adjusting force, the pressure of the cylinder may be controlled by a servo valve which regulates the adjusting force in dependance on an desired value/actual value comparison, with the actual value being determined by measuring the adjusting force, or the distance of the rolls, or the adjusting pressure.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
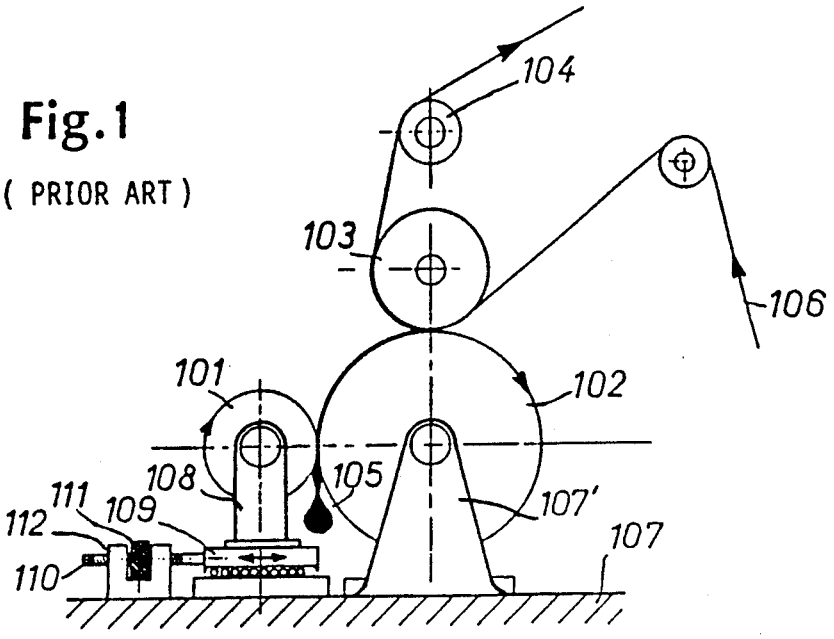
Fig. 1 ( PRIOR ART )
FIG. 1 is a schematic illustration of an applicator rolling mill with a conventional device for adjusting the roll gap between cooperating rolls.

Turning now to the drawing, and in particular to FIG. 1, there is shown a schematic illustration of a conventional applicator rolling mill of a foil coating plant with an application roll 102 securely fixed to a roll stand 107 via a pillow block 107' and cooperating with a metering roll 101 which is freely supported by a bearing block 108 so as to be movable relative to the application roll 102. The metering roll 101 and the application roll 102 are in spaced-apart relationship to define a roll gap therebetween.

Cooperating with the application roll 102 is a coat transmission roll 103 by which the coating is continuously applied onto a foil 106 which is transported by the roll arrangement and suitably guided via pulleys 104. Below the roll gap between the cooperating rolls 101, 102 is a feed reservoir 105 which contains the coating and extends over the width of the roll surface of the rolls or coating width of the plant.

In order to permit an adjustment of the roll gap by which the thickness of the applied layer onto the foil 106 is controlled, the bearing block 108 supporting the metering roll 101 is placed on a carriage 109 which is suitably mounted on the stand 107. Linked to the carriage 109 is one end of a screw spindle 110 which extends through a bifurcated support 112. Threadably engaged on the spindle 110 is a nut 111 which is disposed between the prongs of the bifurcated support 112. Thus, by suitably actuating the nut 111, the carriage 109 is moved by the spindle 110 in a horizontal orientation as indicated by the arrow so as to adjust the relative position of the metering roll 101 relative to the application roll 102 and thus to adjust the roll gap.

The metering roll 101 and the application roll 102 are supported by the pillow block 107' and the bearing block 108 via conventional radial bearings. As can easily be inferred from the arrangement according to FIG. 1, the inner race tolerances of the radial bearings 107', 108 negatively affect the accuracy of the adjusted roll gap even when braced without play.

Figure 2:
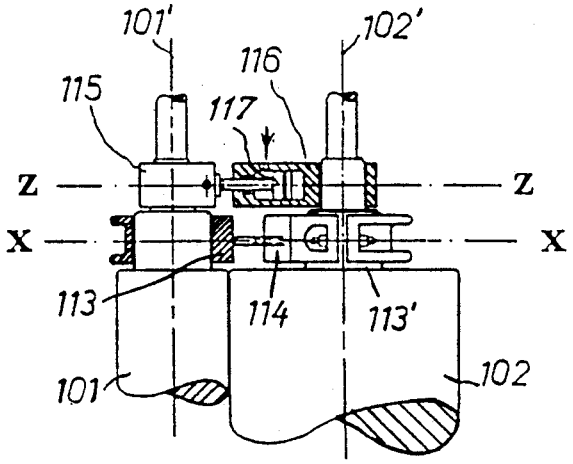
Fig. 2 ( PRIOR ART )
FIG. 2 is a schematic, partly sectional view of cooperating rolls provided with a conventional independent system for supporting the rolls and adjusting the roll gap between the rolls in accordance with EP-A2 242783.

Turning now to FIG. 2, there is shown a schematic, partly sectional view of a calender which attempts to avoid the afore-stated drawbacks by providing an independent or autonomous system for supporting the rolls 101, 102 and for adjusting the roll gap between the rolls 101, 102. According to this conventional design, the elements of the adjusting and support unit are mutually braced and connected in form-fitting and force-locking manner so that the roll gap as defined by the rolls 101, 102 and the distance of the roll axes 101', 102' remain essentially unaffected from disturbances originated e.g. by inaccuracies of the roll bearings 107', 108 in FIG. 1 and/or radial deviations of the roll journals as caused by the spindle couplings acting upon the roll journals.

As is shown in FIG. 2, the journals of the rolls 101, 102 are sustained by a support unit which includes suitable bearings 113, 113' which are spring-biased by means of spring elements (not shown) such as pressure springs, and an adjustable gearbox case 114. The unit for moving the application roll 102 relative to the metering roll 101 and thus for adjusting the roll gap therebetween includes a piston 117 provided with a piston rod which is suitably supported in a bearing 115 mounted on the journal of the metering roll 101. A cylinder block 116 is suitably supported on the journal of the application roll 102 and accommodates the piston 117.

In this autonomous closed system for an adjusting and support unit, the adjustment of the roll gap is attained in the plane z—z which extends at a distance to the supporting plane x—x. Since the forces for adjusting the roll gap are countered by the forces exerted by the support unit, the roll journals of the rolls 101, 102 are subjected to a bending moment which is generally undesired.

Figure 3:
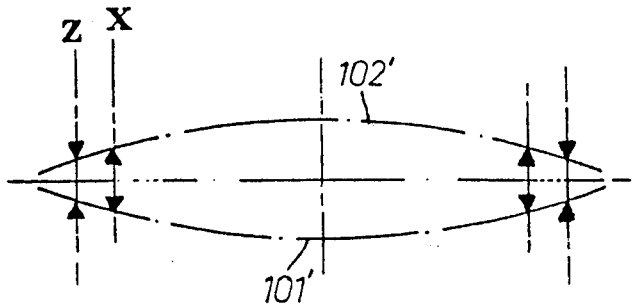
Fig. 3 ( PRIOR ART )
FIG. 3 is a graphical schematic illustration of the bending forces acting upon of the roll journals of the cooperating rolls according to FIG. 2.

FIG. 3 shows a schematic exaggerated illustration of the bending lines of the roll journals 101', 102' as generated by the adjusting and support unit. Evidently, the degree of such roll bending is dependent on the distance between the support plane x—x and adjusting plane z—z as well as on the magnitude for the adjusting force and the moment of resistance of the journal.

Figure 4A:
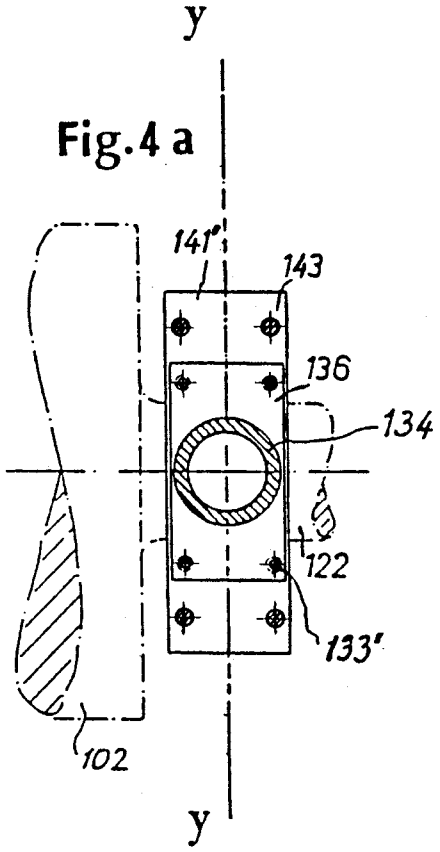
FIG. 4*a* is a sectional view taken along the line IVa—IVa in FIG. 4 and illustrating the adjusting and support unit which is defined by a common symmetrical axis and a common adjusting and support axis.
Figure 4:
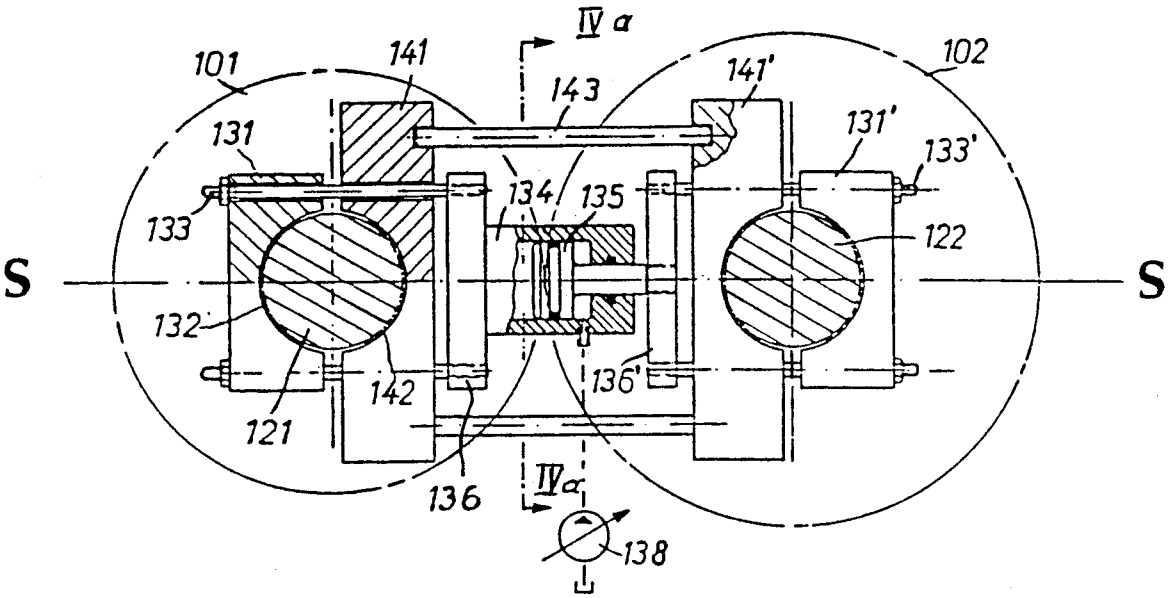
FIG. 4 is a schematic, partly sectional view of a first embodiment of a combined adjusting and support unit for cooperating rolls in accordance with the present invention.

Turning now to FIG. 4, there is shown a schematic, partly sectional view of a first embodiment of an adjusting and support unit in accordance with the present invention. In the nonlimiting example of FIG. 4, the roll arrangement includes the metering roll 101 and the application roll 102 with the respective roll journals 121, 122 being independently supported and guided by the adjusting and support unit in a manner which will be described hereinafter. It will be appreciated that for ease of illustration, the following description refers only to one side of the rolls as both sides are essentially identical in structure.

Mounted to each journal 121, 122 of the rolls 101, 102 is a split bearing shell, with one shell half 131, 131' being part of an adjusting unit and arranged outwardly of the respective roll journal 121, 122 and with the other shell half 141, 141' being part of a support unit and arranged inwardly between the journals 121, 122. The shell halves 141, 141' support the journals 121, 122 free from play and exceed the opposing shell halves 131, 131' in radial direction. The split bearing shell for each roll journal 121, 122 may selectively be a rolling contact bearing or a slide bearing with the cage or the journal-bearing bush indicated by reference numerals 132, 142.

Extending between the shell halves 141, 141' are four pressure spring bars 143 connected to the shell halves 141, 141' at the corners thereof and exerting a suitable force.

The adjusting unit further includes four anchor bolts 133 which are supported and guided by the shell halves 131, 131' and arranged at the corners thereof. The anchor bolts 133 of the shell half 131 for the journal 121 traverse the shell half 141 and are connected to a plate 136 extending parallel to the shell half 141. Securely attached to the side of the plate 136 facing away from the shell half 141 is an adjustable cylinder block 134 which accommodates a piston 135. The piston rod of the piston 135 sealingly projects beyond the cylinder block 134 and is connected to a piston plate 136' extending parallel to the shell half 141'. The piston plate 136' supports the four anchor bolts 133' which traverse the shell half 141' and are securely fixed to the shell half 131' at the corners thereof. The actuation of the piston 135 and thus the control of the roll gap is attained by means of a variable pump 138 with adjustable feed pressure which acts as a pressure scale and communicates with the interior of the cylinder block 134.

Thus, the closed control loop for adjusting the roll gap between the cooperating rolls 101, 102 is essentially defined by the shell half 131 for the journal 121 with the respective anchor bolts 133 operatively connected via plate 136 to the cylinder block 134 with piston 135 being connected to the plate 136' and respective anchor bolts 133' to the shell half 131' which is mounted on the journal 122 of the other roll 102. The forces exerted by the adjusting unit are countered by the forces exerted by the support unit which is defined by the pair of shell halves 141, 141' and the pressure spring bars 143 extending therebetween.

As shown by the sectional view of FIG. 4*a*, the elements of the combined adjusting and the support unit according to the present invention mutually penetrate each other and are guided in such a manner that the forces which are centered and exerted during adjustment and support of the rolls are constantly applied in a common radial plane y—y which extends perpendicular to the axes of the rolls 101, 102 and that the combined arrangement is defined by a common setting plane s—s. Thence, the combined adjusting unit and the support unit according to FIGS. 4 and 4*a* represents in radial as well as in axial orientation a complete autonomous system which is free from any outside forces or moments acting upon the stand or acting in direction of the roll journals.

Figure 4B:
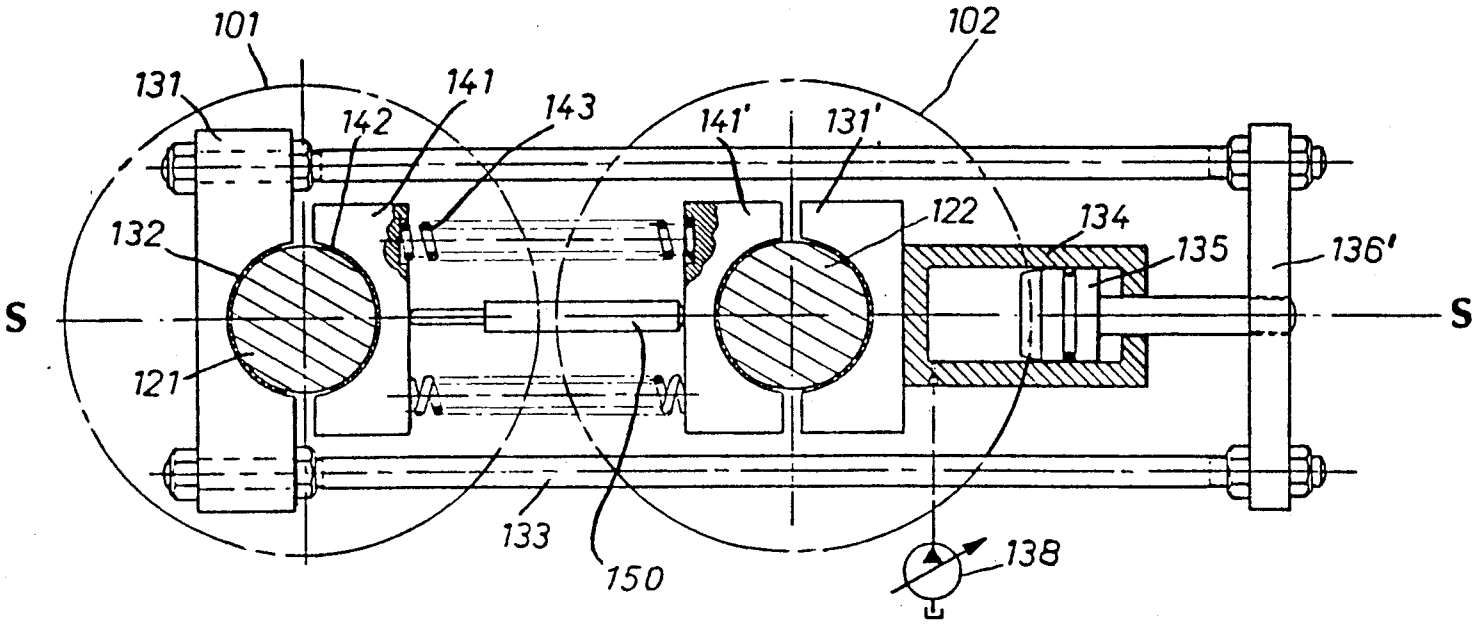
FIG. 4*b* is a modified, partly sectional view of the first embodiment of a combined adjusting and support unit for cooperating rolls in accordance with the present invention and illustrating an external application of the adjusting force.

In the roll compound structure according to FIG. 4, the adjusting cylinder block 134 with the piston 135 and plates 136, 136' are arranged inwardly between the journals 121, 122. It will be readily recognized that the cylinder block 134 with the piston 135 and the plate 136' may be arranged also outside the inner roll journal area as illustrated in FIG. 4*b*. The shell half 131 which is mounted on the journal 121 of the metering roll 101 exceeds the opposing shell half 141 in radial direction and is directly connected via four anchor bolts 133 to the piston plate 136' which extends at a distance to the shell half 131' mounted on the journal 122 of the application roll 102 and opposing the shell half 141'. Extending between the shell half 131' and the piston plate 136' is the cylinder/piston unit 134, 135, with the cylinder 134 securely attached to the shell half 131' and the piston 135 being connected via its piston rod to the piston plate 136'. The variable pump 138 operating as pressure scale suitably communicates with the interior of the cylinder 134.

The support unit essentially corresponds to the support unit as shown in FIG. 4 and includes the shell halves 141, 141' for supporting the journals 121, 122 and the pressure spring bars 143 extending between the shell halves 141, 141' in the inner roll journal area. Extending centrally between the facing shell halves 141, 141' is a sensor 150 for measuring the spacing between the rolls 101, 102.

The embodiment of the support and adjusting unit according to FIG. 4*b* is especially suitable for adjusting the roll gap over a wide range and is in particular of relevance for the indispensable Gap-Emergency-Open operation of the arrangement. The support and adjusting unit operates in a same functional manner as the embodiment as shown in FIG. 4, with the forces exerted by the pressure spring bars 143 urging the roll journals 121, 122 apart in opposite direction to the forces exerted by the adjusting unit.

Figure 5:
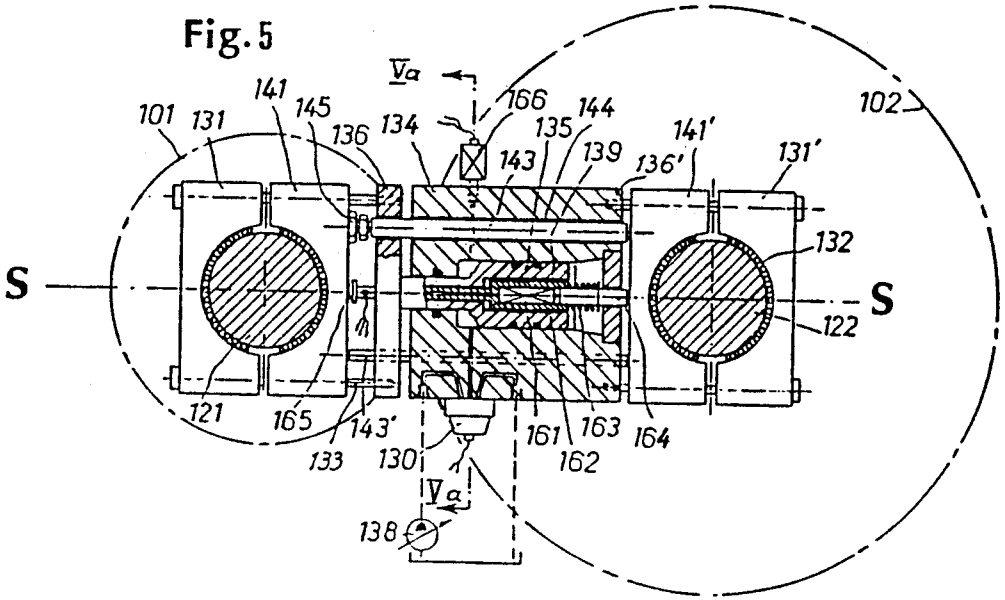
FIG. 5 is a schematic, partly sectional illustration of a compact adjusting and support unit in accordance with the present invention and provided with an integral path measuring unit for determining the distance between the roll journals.

Turning now to FIG. 5, there is shown a schematic, partly sectional illustration of a compact adjusting and support unit in accordance with the present invention and provided with an integral path measuring unit for determining the distance between the roll journals. In correspondence with the embodiment of FIG. 4, split bearing shells are mounted on the journals 121, 122 of the rolls 101, 102, with shell halves 131, 131' mounted outwardly on the respective roll journals 121, 122 and being part of the adjusting unit and shell halves 141, 141' opposing the shell halves 131, 131' and being part of the support unit.

Figure 5A:
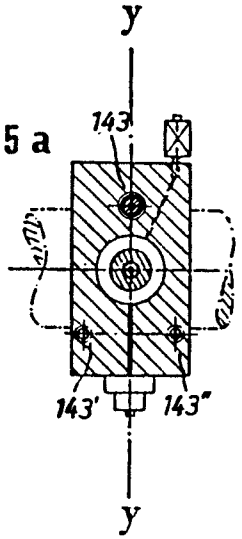
FIG. 5*a* is a sectional view of the adjusting and support unit of FIG. 5 taken along the line Va—Va in FIG. 5.

The shell halves 141, 141' are connected with each other by three pressure spring bars 143, 143', 143'' (FIG. 5*a*) which are arranged in form of a tripod so that the individual pressure spring bars have—relative to the central adjusting axis s—s—the same specific supporting moment which is equal to the distance of support from center x spring stiffness. The pressure spring bars 143, 143', 143'' are retained and guided in suitable longitudinal guides 144 which traverse the piston plate 136 and the cylinder block 134 of the adjusting unit.

The shell half 131 is connected to the piston plate 136 via the anchor bolts 133 which traverse the opposing shell half 141. The piston plate 136 is inwardly arranged between the shell half 141 and the cylinder block 134 at a distance thereto and is acted upon by one end of the adjusting piston 135 of the cylinder block 134. The piston 135 is tubular for guiding a path measuring device which includes a casing 162 arranged within the piston 135 and supported therein by an axial bearing. Embedded in the casing 162 is a position sensor 161 which is guided by the casing and freely movable relative to the piston 135 regardless of the adjustment of the piston 135. The position sensor 161 is spring-biased by means of a pressure spring 163 which bears with one end thereof against the casing 162 and with its other end against a cam follower 164 extending at the end face of the cylinder block 134. The opposing ends of the position sensor 161 are guided by the respective piston plate 136 and the plate 136' and bear against stops 164, 165 at the shell halves 141, 141' which support the roll journals 121, 122 free from play. Closing the control loop is the other shell half 131' which is connected via anchor bolts 133' with the cylinder block 134.

Through the provision of a path-measuring device, the distance between the rolls 101, 102 and the roll gap, which at centrally ground roll surface is proportional to the roll distance, can be accurately determined. The adjustment of the roll gap may be attained in a manner as described in connection with FIG. 4, i.e. free of valves by means of the variable pump 138 which is suitably connected with the interior of the cylinder block 134. Such a control of the adjusting force is, however, suitable only in those cases in which no high standard is demanded with regard to the accuracy of the layer thickness.

Figure 7:
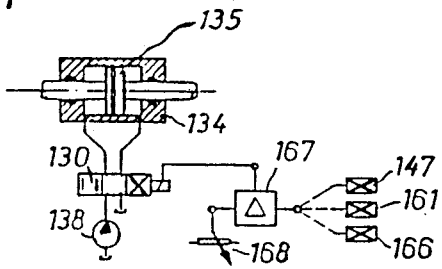
FIG. 7 is a schematic illustration of a closed loop for controlling the roll gap by using three alternative actual value transducers.

If, however, a high accuracy is demanded, the adjustment of the roll gap and thus the control of the adjusting force is obtained with more sophisticated means as schematically shown e.g. in FIG. 7. Accordingly, a servo valve 130 is interposed between the pump 138 and the cylinder 134 for regulating the adjustment force of the cylinder 134 in dependence on the output of a reference value/actual value comparator 167. Operatively connected to the comparator 167 is a voltage source 168 which provides the reference value. The comparator 167 further communicates with three transducers 147, 161, 166 by which three actual values can alternatingly be transmitted. The transducer 147 delivers a signal corresponding to the adjusting force and is provided in form of a load cell; the transducer 166 is a pressure gage 166 for measuring the pressure in the cylinder block 134, and the transducer 161 is the position sensor which delivers a signal in correspondence with the distance of the rolls.

Figure 6:
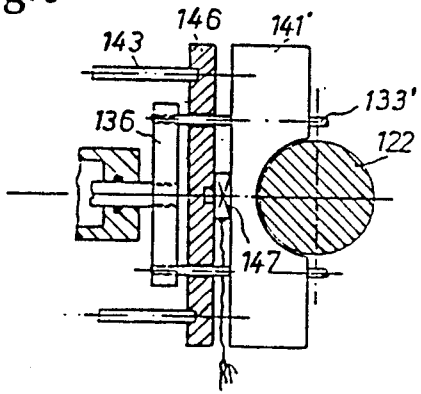
FIG. 6 is a schematic, partly sectional view of a modification of the support for the rolls and illustrating a load cell for determining the adjusting force.

As shown in FIG. 6, in case the comparator 167 receives an actual value in correspondence with the adjusting force, the load cell 147 is provided between the shell half 141' and an intermediate plate 146, with the pressure spring bars 143 ending in the intermediate plate 146. Thus, the supporting force of the pressure spring bars 143 is measured by the load cell 147 and accordingly regulated by the comparator 167 and the servo valve 130.

Usually, it is necessary to provide a mechanical/electrical zero-calibration of the roll gap by means of the distance-determining support unit which has a linear characteristic curve (in the Hookean area) essentially predetermined by the stiffness of the pressure spring bars 143, 143', 143''. As shown in FIG. 5, a gap adjusting device 145 is provided at one end of at least one of the pressure spring bars e.g. pressure spring bar 143 for allowing adjustment of the force/distance characteristic curve of the pressure spring bar 143.

While the invention has been illustrated and described as embodied in an apparatus for adjusting the roll gap between cooperating rolls, it is not intended to be limited to the details shown since various modifications and structural changes may be made without departing in any way from the spirit of the present invention.

What is claimed as new and desired to be protected by Letters Patent is set forth in the appended claims:

1. Apparatus for adjusting the roll gap between cooperating rolls of a rolling stand, with each roll having a roll journal and defining an axis; comprising adjusting means for controlling the roll gap between the rolls and including a bearing shell half mounted outwardly relative to the roll gap on each roll journal and adjusting elements acting upon said bearing shell halves of said adjusting means, said adjusting means exerting upon said roll journals a first force; and support means including a bearing shell half for supporting each roll journal and a plurality of support elements extending between said bearing shell halves of said support means, said bearing shell halves of said support means being arranged inwardly between said roll journals, said adjusting means and said support means defining an autonomous and closed adjusting and supporting system, with said support means exerting upon said roll journals a second force opposing the first force exerted by said adjusting means, whereby the first and second forces act in a common radial plane extending perpendicular to said axes of said rolls.

2. Apparatus as defined in claim 1 wherein said bearing shell half of said adjusting means is mounted outwardly relative to the roll gap on each roll journal opposite to said shell half of said support means, with said adjusting elements extending between said bearing shell halves of said adjusting means within an area between said roll journals.

3. Apparatus as defined in claim 2 wherein said adjusting elements includes a cylinder/piston unit with a cylinder block operatively connected to one of said shell halves of said adjusting means and with a piston operatively connected with the other one of said shell halves of said adjusting means.

4. Apparatus as defined in claim 3 wherein said cylinder/piston unit is arranged between said shell halves of said adjusting means within an area between said roll journals.

5. Apparatus as defined in claim 3, and further comprising guide means including longitudinal guides for guiding said support elements, said longitudinal guides being arranged in said cylinder block.

6. Apparatus as defined in claim 3 wherein said adjusting means further includes a pump with adjustable feed pressure and operatively connected to said cylinder/piston unit for setting the adjusting force of said cylinder/piston unit.

7. Apparatus as defined in claim 6, and further comprising regulating means including a servo valve and a reference value/actual value comparator for controlling the adjusting force of said cylinder/piston unit in dependence on a comparison between a reference value and an actual value.

8. Apparatus as defined in claim 7 wherein said piston is tubular for allowing said regulating means to freely move within said piston, said regulating means being path-measuring means including a casing accommodated in said piston and supported in an axial bearing, and a spring-loaded position sensor bearing against said shell halves of said support means and communicating with said comparator to provide the actual value in correspondence with the distance of said rolls.

9. Apparatus as defined in claim 7 wherein said cylinder/piston unit exerts an adjusting pressure, said regulating means including a pressure gage operatively connected to said comparator for determining the adjusting pressure and providing the actual value in correspondence with the determined pressure

10. Apparatus as defined in claim 7 wherein said support means includes a support plate spaced from one of said shell halves of said support means for receiving said support elements, said regulating means including a load cell arranged between said support plate and said one shell half for determining the supporting force of said support elements and being operatively connected to said comparator for providing the actual value in correspondence with the determined supporting force.

11. Apparatus as defined in claim 1 wherein said bearing shell half of said adjusting means is mounted outwardly relative to the roll gap on each roll journal opposite to said shell half of said support means, with said adjusting elements extending externally of one of said bearing shell halves of said adjusting means outside an area between said roll journals.

12. Apparatus as defined in claim 11 wherein said adjusting elements includes a cylinder/piston unit with a cylinder operatively connected to one of said shell halves of said adjusting means and with a piston operatively connected with the other one of said shell halves of said adjusting means, said cylinder/piston unit being arranged outside said area between said roll journals.

13. Apparatus as defined in claim 1 wherein said adjusting means defines a central adjusting axis and wherein three support elements are provided between said shell halves, said support elements being defined relative to said central adjusting axis by a same specific supporting moment.

14. Apparatus as defined in claim 1, wherein each of said support elements is a pressure spring bar.

15. Apparatus as defined in claim 1, and further comprising an adjusting unit operatively connected to at least one of said support elements for calibrating said one support element and gaging the roll gap.

* * * * *